United States Patent [19]

Anderson

[11] 4,300,253

[45] Nov. 17, 1981

[54] QUICK ASSEMBLY BLIND FOR BOATS

[76] Inventor: William L. Anderson, Box 74, Savoy, Ill. 61874

[21] Appl. No.: 59,657

[22] Filed: Jul. 23, 1979

[51] Int. Cl.[3] ..... B63B 17/00; B63B 17/02

[52] U.S. Cl. ..... 9/1.5; 9/1.7; 296/138; 135/6

[58] Field of Search ..... 43/1; 135/6; 114/71; 9/1.5, 1.7, 5, 4 R, 4 A; 296/138

[56] References Cited

U.S. PATENT DOCUMENTS 143,052 9/1873 Adams ..... 135/6

630,497 8/1899 Geiger ..... 296/138

1,240,006 9/1917 Austin ..... 296/138

3,604,440 9/1971 Wilson ..... 9/1.5

*Primary Examiner*—Trygve M. Blix

*Assistant Examiner*—D. W. Keen

*Attorney, Agent, or Firm*—Luedeka & Fitch

[57] ABSTRACT

A quick assembly blind for use in combination with an open top boat. The blind comprises generally a rectangular framework releasably secured to the boat and extending above the boat. Drapable curtains depend from the framework to close the blind. A portion of the framework is resiliently mounted to permit quick assembly and/or disassembly.

5 Claims, 15 Drawing Figures

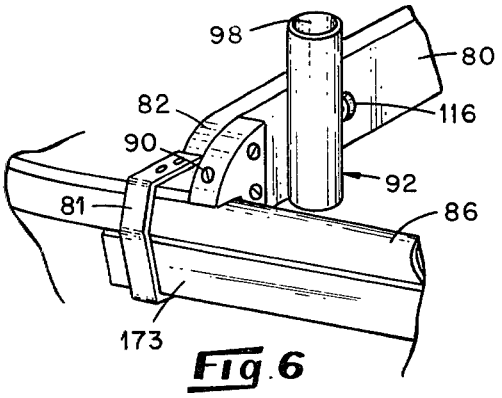
Fig. 6
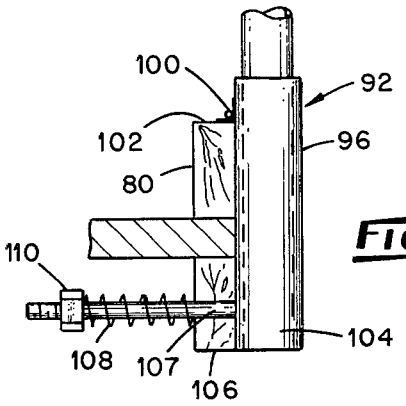
Fig. 5
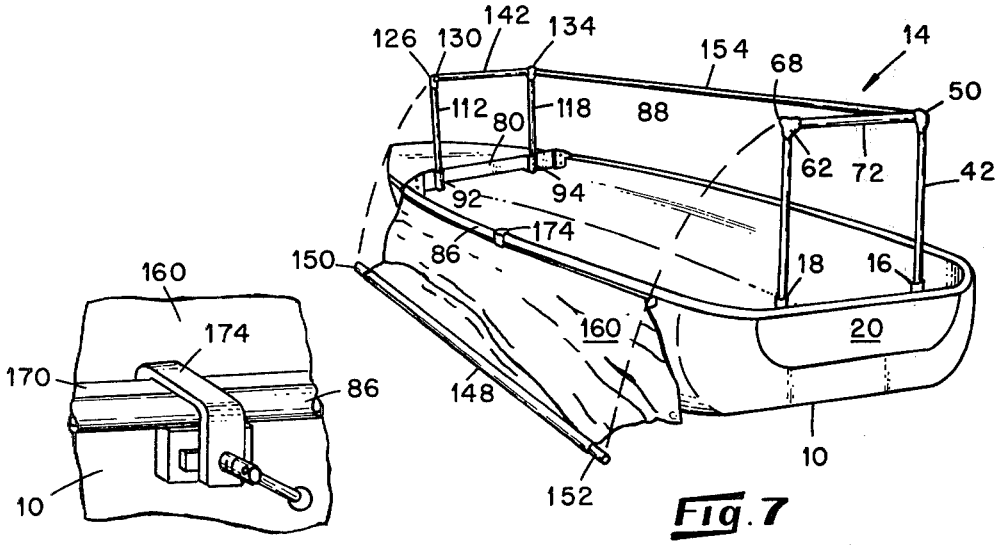
Fig. 7
Fig. 8

QUICK ASSEMBLY BLIND FOR BOATS

This invention relates to blinds usefulk in concealing oneself when hunting or observing wild life, and particularly to a hunting blind for use in combination with a boat.

Blinds of the type employed by hunters of waterfowl in combination with boats heretofore commonly have been of rigid construction, cumbersome in handling either during setup or takedown, difficult to transport and/or otherwise unsatisfactory. One of the most restrictive features of such prior blinds is the restriction which they present to over-the-gunnel work activities. These activities include the placing and retrieving of decoys, boat paddling movements and/or the retrieval of downed game. Likewise, such prior blinds present substantial hazard to the user as he attempts to enter or leave the boat.

Accordingly, it is an object of the present invention to provide an improved blind to be used in combination with a boat. It is another object of this invention to provide a blind which is quickly and easily assembled. It is another object of this invention to provide a blind in combination with a boat which provides for unrestricted over-the-gunnel work activities. Other objects and advantages of the invention will be recognized from the following description, including the drawings in which:

FIG. 5 is a detailed view of a bow base mount for a portion of the support structure of the blind;

FIG. 6 is a detailed view of the mounting of a member for supporting the side curtain of the present blind;

FIG. 7 is a representation of a partially assembled blind;

FIG. 8 is a detailed representation of a clamp means for securing a rib member for the side curtain of the blind to a boat gunnel;

Figure 1:
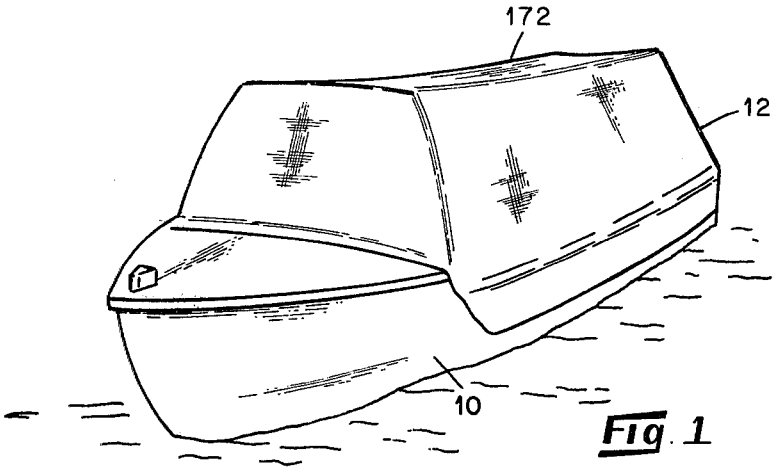
FIG. 1 is a representation of a boat incorporating a blind embodying various features of the invention.
Figure 2:
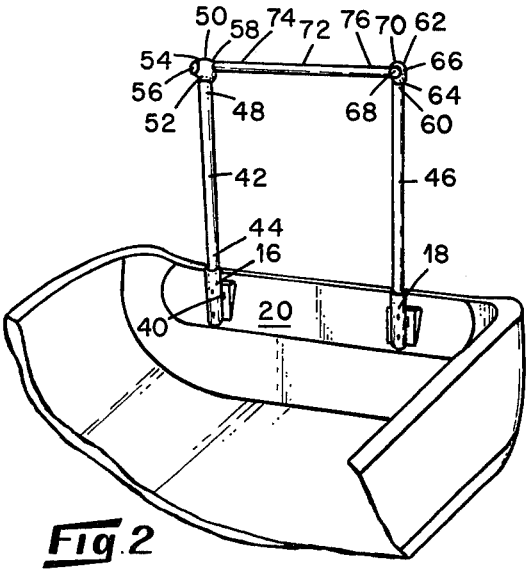
FIG. 2 is a fragmentary view showing the transom of the boat depicted in FIG. 1 and portions of the blind framework associated with such transom.
Figure 3:
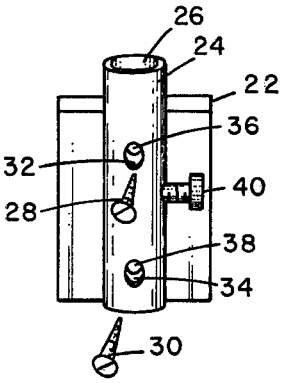
FIG. 3 is a detailed view of a transom base mount employed in the present blind.

With reference to the figures, there is shown in FIGS. 1 and 2, specifically, a boat 10 having provided in combination therewith a blind 12 in accordance with the present disclosure. With specific reference to FIG. 7, the blind comprises a framework indicated generally by the numeral 14. This framework includes starboard and port base mounts 16 and 18, respectively, which are secured to the transom 20 of the boat at locations adjacent the starboard and port sides of the boat. As shown in FIGS. 2 and 3, each depicted base mount, 16, for example, comprises a block 22 adapted to be secured to the transom 20. The block 22 is provided with a tubular member 24 which defines a receptacle 26 that opens upwardly when the mount is secured to the transom. The tubular member 24, in the depicted embodiment, is secured to the block 22 by means of screws or the like 28 and 30 that are received through openings 32 and 34, respectively, through the wall of the member 24, thence through further openings 36 and 38, respectively, in the diametrically opposite wall of the member 24. The openings 32 and 34 are sufficiently large to pass the heads of the screws 28 and 30, but the dimensions of the openings 36 and 38 are such that the heads of the screws 28 and 30 seat against the wall of the tubular member 24 when the screws are in position to hold the tubular member secured to the block 22. A set screw 40 is threadably fitted through the wall of the tubular member 24 for purposes which will appear hereinafter. The port transom base mount 18 is substantially identical in construction to the starboard transom base mount 16.

As may be best seen in FIG. 2, a starboard upright standard 42 is received at its end 44 within the receptacle 26 of the starboard base mount 16 such that the standard 42 is maintained uprightly. The set screw 40 is tightened against the outer wall of the end of the standard 42 disposed within the receptacle 26, thereby releasably securing the standard in its mount. A port upright standard 46 is identically mounted within the port transom base mount 18 and extends upwardly, generally parallel to the starboard upright standard 42.

The upper end 48 of the starboard standard 42 is provided with a starboard transom corner mount 50 which in the depicted embodiment comprises three legs, the first leg 52 of which defines a downwardly opening receptacle into which there is slidably received the upper end 48 of the standard 42. The second leg 54 of the corner mount 50 defines a first receptacle 56 which opens in a direction generally parallel to the longitudinal centerline of the boat and toward the bow of the boat. The third leg 58 of the corner mount 50 defines a second receptacle which opens in a direction generally perpendicular to the longitudinal centerline of the boat and toward the port side of the transom. The upper end 60 of the port transom standard 46 is provided with a similar three-leg corner mount 62, the first leg 64 of which defines a downwardly opening receptacle into which is slidably received the upper end 60 of the standard 46. The second leg 66 of the corner mount 62 defines a first receptacle 68 which opens in a direction generally parallel to the centerline of the boat and facing toward the bow of the boat. The third leg 70 of the corner mount 62 defines a receptacle which opens in a direction generally perpendicular to the centerline of the boat and toward the starboard side of the transom 20. An elongated transom cross-member 72 is fitted at its opposite ends 74 and 76 into the receptacles defined by the third legs 58 and 70 of the corner mounts 50 and 62, respectively.

The framework 14, adjacent the bow 78 of the boat includes a first bow cross-member 80 which extends across the width of the boat at a location adjacent the bow 78 and has its opposite ends 82 and 84 secured to the port gunnel 86 and the starboard gunnel 88, respectively. As shown in FIG. 6, the end 82 of the first bow cross-member 80 may be secured to the gunnel by means of a screw 90.

Figure 4:
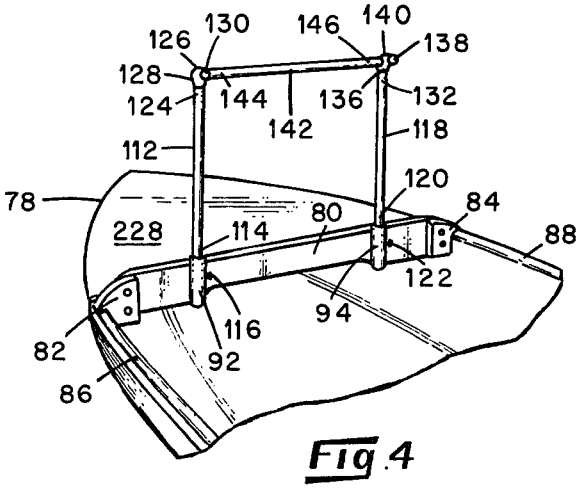
FIG. 4 is a fragmentary view of the bow portion of the boat depicted in FIG. 1 and showing portions of the blind associated with such bow portion.
Figure 9:
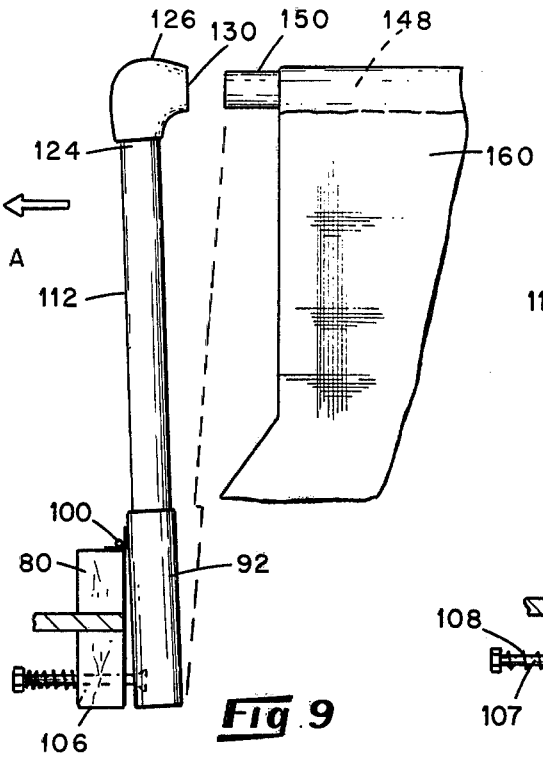
FIGS. 9 and 10 are fragmentary views showing the assembly and disassembly of the side curtain portion of the present blind.
Figure 10:
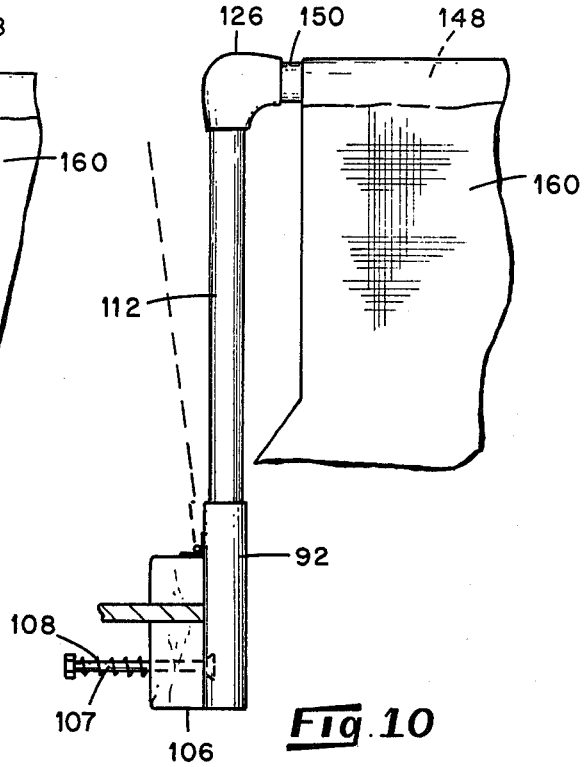

Referring to FIGS. 4, 5 and 6 specifically, there is secured to the bow cross-member at a location adjacent the port side thereof, a port bow base mount 92. A substantially identical starboard bow base mount 94 is secured to the cross-member 80 at a location adjacent the starboard gunnel 88. With specific reference to FIGS. 5 and 6, the port bow base mount 92 comprises a tubular member 96 which defines a receptacle 98 that opens upwardly. This base mount 92 is hingedly mounted, by means of a hinge 100, to the top surface 102 of the bow cross-member 80. The lower end 104 of the base mount 92 is secured to the lower edge 106 of the bow cross-member 80 by means of a threaded screw 107 which extends through the wall of the base mount 92, thence through the thickness of the bow cross-member 80 and therebeyond to receive a compression spring 108 thereon. The inboard end of the spring 108 contacts the bow cross-member 80 while its outboard end is retained by a nut 110 threaded onto the screw 107. In this manner, it will be recognized that the base mount 92 is biased by the spring 108 toward an upright position, but such base mount is movable about the pin of the hinge 100 to a nonupright position. This hinge movement of the base mount 92 is depicted in FIGS. 9 and 10. In the preferred embodiment, the starboard base mount 94 is identically hingedly mounted to the bow cross-member 80 at a location adjacent the starboard gunnel. Whereas this described hinge mounting is preferred, it will be recognized that other means may be employed to provide a resilient type mounting that provides for movement of the base mount between upright and nonupright positions, that is, for pivoting of the standard about its base mount by up to about 30 degrees from the vertical.

With reference to FIG. 4, the framework of the blind in the bow portion thereof further includes a port upright standard 112 whose lower end 114 is slidably received within the receptacle 98 of the port base mount 92. A set screw 116 is provided in the base mount 92 to secure the end of the standard 112 within the base mount 92. An identical upright starboard bow standard 118 is provided with its lower end 120 removably inserted within the starboard base mount 94 and similarly held by a set screw 122. The upper end 124 of the port upright standard 112 has received thereon a port bow corner mount 126 of three legged construction. The first leg 128 of the corner mount 126 slidably receives therein the upper end 124 of the standard 112. The second leg of the corner mount 126 defines a first receptacle 130 which opens in a direction parallel to the longitudinal centerline and facing the transom of the boat. The third leg of the corner mount (not visible in the figures) defines a second receptacle which opens in a direction perpendicular to the longitudinal centerline and facing the starboard side of the boat. This corner mount as well as others of the framework may be permanently secured to a respective standard, if desired.

The upper end 132 of the starboard upright standard 118 is similarly provided with a three legged corner mount 134, the first leg 136 of which slidably receives therein the upper end 132 of the standard 118. The second leg of the corner mount 134 defines a first receptacle 138 which opens in a direction generally parallel to the longitudinal centerline and facing the transom of the boat. The third leg 140 of the corner mount 134 defines a second receptacle which opens in a direction generally perpendicular to the longitudinal centerline and facing the port side of the boat. A second bow cross-member 142 is disposed between the upper ends of the port and starboard standards 112 and 118 with its opposite ends 144 and 146 slidably received within the corner mounts 126 and 134, such ends being slidably received within the facing receptacles defined by the third legs of these corner mounts.

Referring to FIG. 7, the framework includes an elongated port support member 148 that is adapted to extend between the port bow standard 112 and the port transom standard 46. The support member 148 is supported between these standards by reason of the bow end 150 of the member 148 being slidably received within the first receptacle 130 defined by the corner mount 126 that is associated with the port upright standard 112. In like manner, the opposite end 152 of the support 148 is slidably received within the first receptacle 68 defined by the port transom corner mount 62. A substantially identical starboard elongated support member 154 is provided which is mounted between the starboard bow standard 118 and the starboard transom standard 42 in a manner identical to the aforedescribed mounting of the support member 148 between the port standards.

In a preferred embodiment, the framework 14 is generally made up of aluminum or the like tubing which provides the rigidity and light weight desired for ease of portability. For example, one and one-sixteenth inch O.D., thick-walled aluminum tubing has been found to serve most satisfactorily as the construction material for the standards 42, 46, 112, and 118, the transom cross-member 72, the second bow cross-member 142, and the elongated support members 148 and 154. As will be recognized from reviewing the accompanying drawings, the tubing sections which comprise the standards 42, 46, 112 and 118 are of a size which readily slide within the upwardly opening receptacles defined by the transom base mounts 16 and 18 and the bow base mounts 92 and 94 thereby positioning these standards in relatively rigid upright positions when they are so installed. By reason of the longitudinal dimension of the tubular members which make up each of the base mounts, the standards retain their respective upright positions unless the base mounts are themselves moved. In this manner, when the elongated support members 148 and 154 are fitted between their respective port standards and starboard standards, the supports 148 and 154 remain in position and become an integral part of the framework. As discussed hereinbefore, however, the bow base mounts 92 and 94 are biased toward their upright positions by means of the spring 108 (and the like spring which serves as a part of the mounting of the base mount 94). By reason of the heretofore described hinged mounting of the bow base mounts 92 and 94, when the standards 112 and 118 are in position within these base mounts, the standards 112 and 118 may be moved to nonupright positions as shown in FIG. 9 for the standard 112 through the application of a force applied to the upper end 124 of the bow standard 112 in a direction toward the bow 78. It will be recognized that the standard 118 is movable to a nonvertical position in a manner identical to the standard 112. Accordingly, in assembling the framework 14, the end 152 of the support 148 is first inserted in the corner mount 62 on the transom end of the framework and thereafter the bow end 150 of the member 148 is brought into generally vertical and horizontal alignments with the second receptacle 130 of the corner mount 126. The upper end 124 of the standard 112 is thereupon urged toward the bow of the boat (in the direction of the arrow A as shown in FIG. 9) by a distance sufficient to complete the alignment of the end 150 of the member 148 with the receptacle 130. Thereupon, the standard 112 is allowed to return under the force of the bias provided by the spring 108 to its upright position which permits the end 150 of the support member 148 to be slidably received within the corner mount 126. It will, of course, be recognized that the removal of the end 150 from the corner mount 126 is effected by again pulling the standard 112 in a direction toward the bow of the boat in opposition to the biasing force of the spring 108 to release the end 150 from the corner mount 126.

Further, in a preferred embodiment, the transom base mounts 16 and 18 are spaced apart by a distance of about 22 inches. The bow base mounts 92 and 94 are spaced apart by a like distance. Accordingly, the support members 148 and 154 are spaced apart by about 22 inches when they are in their respective positions for use. This distance permits a person to stand within the boat and be comfortably received between the supports 148 and 154 when these supports are in their respective positions within the framework 14. Further, in a preferred embodiment, the bow base mounts 92 and 94 are located substantially adjacent the bow of the boat but not so far forward as results in an overly expansive square footage of side curtain which not only is bulky and difficult to manipulate but which exerts too great a weight for support by the supports 148 and 154 over their respective lengths. Further, in certain circumstances the location of the bow base mounts may be dictated by the desired expanse of the deck 78. The length of the support members 148 and 154 are identical and, as depicted, are sufficient to cause these support members to extend fully between the transom portion and the bow portion of the framework 14.

Figure 11:
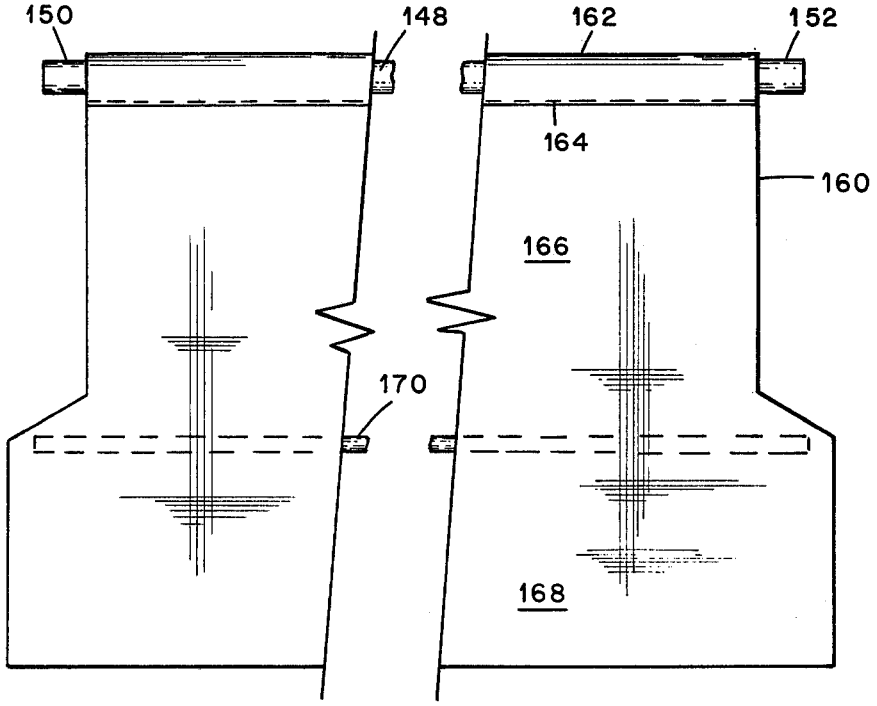
FIG. 11 is a plan view of a side curtain portion of the blind.

To conceal a person within a boat fitted with a framework 14, the framework is provided with curtain means. In the depicted embodiment, this curtain means comprises a port side curtain 160 which is depicted in FIG. 11. As shown, the port side curtain 160 includes an upper edge 162 which is folded back upon itself and stitched as at 164 to define a loop within which there is received the elongated support member 148. The body 166 of the curtain 160 depends from the support 148 when such support is disposed between the port standards 46 and 112. The body of the curtain 160 slopes downwardly and outwardly from the support member 148 to a vertical level which is at or below the vertical level of the port gunnel 86 of the boat and is further provided with a skirt portion 168 which extends below the port gunnel 86 but terminates above the waterline of the boat. The curtain 160 has secured thereto a rigid rib 170 at a location on the curtain which is approximately collinear with the port gunnel 86 when the blind is assembled and the curtain 160 depends from the support member 148 over the gunnel 86. This rib 170 preferably comprises a length of wood such as a $\frac{3}{4}$ inch thick $\times 1\frac{1}{2}$ inch wide strip which is substantially equal in length dimension of the curtain 160 at this location. There is further provided a starboard curtain 172 that is substantially identical to the port curtain 160 and which is supported on the framework by means of the starboard support member 154.

The depending body and skirt portion 166 and 168 of the side curtain 160 are secured to the boat only by means of an anchoring of the rib 170 to the gunnel 186, in a preferred embodiment, thereby providing for rapid attachment and/or release of the curtain 160 to the gunnel 86. In the depicted embodiment, this attachment of the rib 170 to the gunnel 86 is accomplished by means of a C-clamp 174. Other suitable quick release mechanisms such as toggle clamps may be employed for this purpose. It will be recognized that additional C-clamps may be employed along the length of the gunnel 86 if desired. Further, in a preferred embodiment, the bow end 173 of the rib 170 is inserted in the bracket 81 to anchor such end of the rib while its opposite end is anchored by means of the C-clamp.

Figure 12:
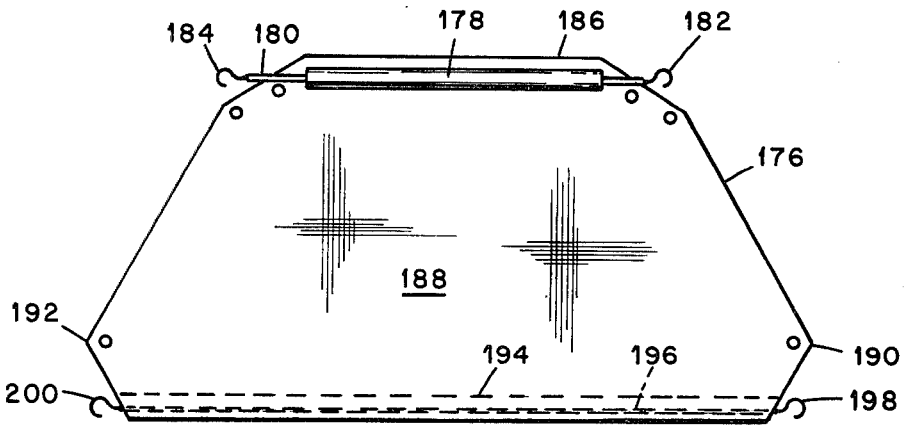
FIG. 12 is a plan view of a bow curtain portion of the blind.
Figure 14:
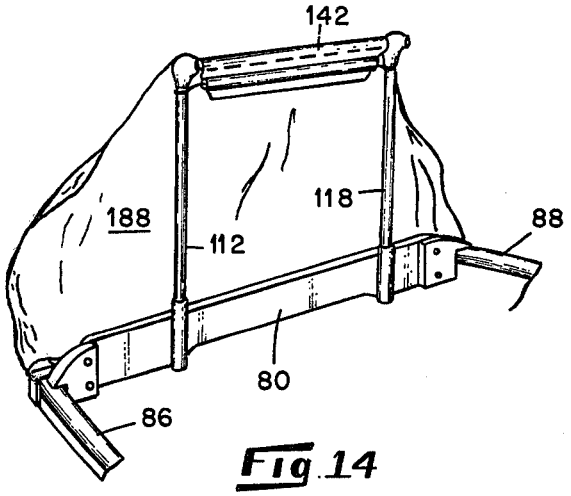
FIG. 14 is a view showing assembly of the bow curtain portion of the blind.

The bow portion of the framework 14 is draped with a bow curtain 176, a preferred embodiment of which is depicted in FIG. 12. In this depicted bow curtain, there is attached thereto a tubular member 178 such as a length of conduit through which there is threaded an elastic snubber 180 having hooks 182 and 184 on the opposite ends thereof. To install the bow curtain, the curtain is positioned outside the framework 14 and the upper edge 186 thereof is wrapped over the bow cross-member 142. The hooks 182 and 184 are hooked about the upper ends of the bow standards 112 and 118 as best seen in FIG. 14, thereby securing the bow curtain in position such that the body 188 thereof depends from the bow cross-member 142 downwardly to a vertical height approximately equal to the vertical height of the plane occupied by the boat gunnels. Preferably, the bow curtain 176 includes wings 190 and 192 on the opposite sides thereof which project laterally from the bow standards 112 and 118 by a distance sufficient to fully enclose the bow portion of the blind when the side curtains are in position and to overwrap the bow side edges of the opposite side curtains. The bottom edge 194 of the bow curtain 176 is, in the depicted embodiment, provided with an additional elastic snubber 196 having hooks 198 and 200 on the opposite ends thereof which are adapted to engage the gunnels 88 and 86, respectively, or other locations on opposite sides of the boat such as the opposite ends of the bow cross member 80 or brackets 81 provided to aid in mounting of the bow cross-member 80 in position to anchor the lower edge 194 of the bow curtain. As thus secured in position, the bow curtain is highly resistant to dislodgment or dislocation by winds forces, especially when the boat is facing into the wind. Further, the aforedescribed mounting of the bow standards provides that wind forces acting on the bow curtain tend to urge the bow standards toward their upright position for supportive engagement with the elongated side curtain support members.

Figure 13:
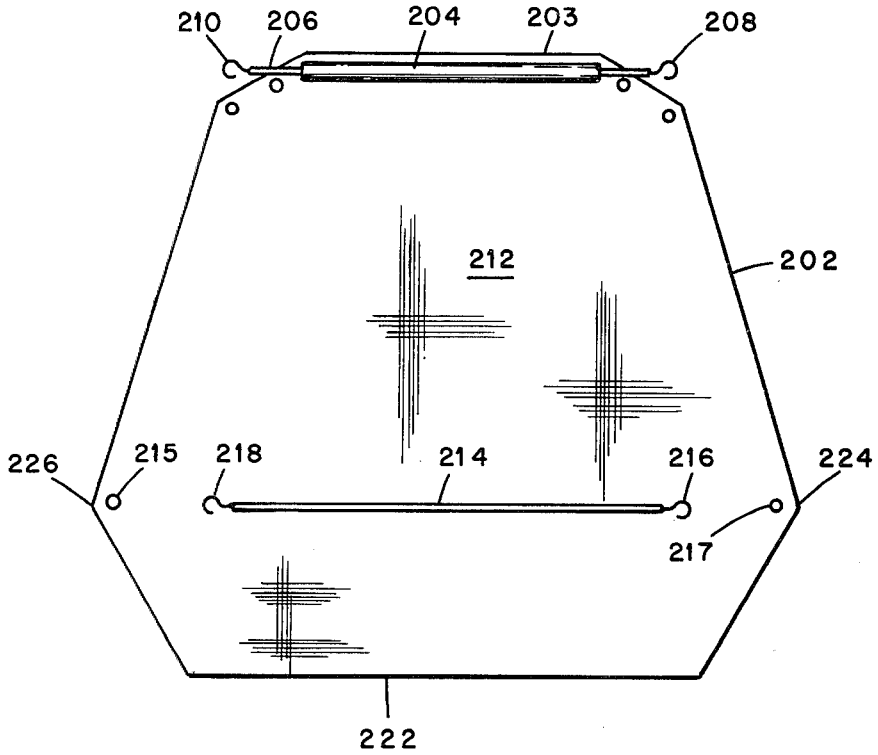
FIG. 13 is a plan view of the starboard curtain portion of the blind.
Figure 15:
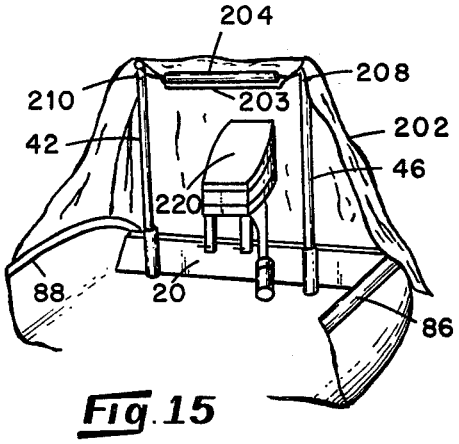
FIG. 15 is a fragmentary view showing the assembly of the transom curtain portion of the blind.

The transom portion of the framework 14 is closed by means of a transom curtain 202, a preferred embodiment of which is depicted in FIG. 13. The transom curtain 202 is provided at its top edge with a conduit 204 through which there is threaded an elastic snubber 206 having hooks 208 and 210 on its opposite ends. In like manner as described above in connection with the bow curtain 176, the transom curtain 202 is secured at its upper edge 203 to the transom cross-member 72 by overwrapping the top edge 203 of the curtain 202 about the cross-member 72 and engaging the hooks 208 and 210 about the upright transom standards 46 and 42, respectively. The body 212 of the transom curtain 202 depends from the cross-member 72 to a vertical height below the top edge of the transom but above the waterline of the boat. The lower portion of the curtain 202 is provided with a further elastic snubber 214 having hooks 216 and 218 on the opposite ends thereof which are adapted to be received in grommets 215 and 217 (FIG. 13) to anchor the lower portion of the curtain against movement. As seen in FIG. 15, this transom curtain, when in position, overwraps the outboard motor 220 of the boat to camouflage such motor. In a preferred embodiment, the bottom edge 222 of the curtain 202 terminates above the foot of the outboard motor 220 so that the outboard motor can be operated with the transom curtain in position. As depicted, the transom curtain 202 includes lateral wings 224, 226 which spread laterally to close any gap defined by the side curtains which slope outwardly and downwardly over the gunnels.

A preferred material of construction of the curtain means is a canvas type material. It will be recognized, however, that a woven or nonwoven mesh material may be employed. As desired, a camouflage pattern may be provided on the exposed surfaces of the curtain means. In the depicted embodiment, a deck 228 is provided at the bow of the boat forwardly of the first bow cross-member 80 to close any portion of the bow not covered by the bow curtain 176.

Assembly of the present blind is relatively simple and can be accomplished quickly. In the usual situation, the transom base mounts are permanently secured to the transom. Likewise, the first bow cross-member 80 with its bow base mounts 92 and 94 is initially secured to the boat gunnels and left in such position. The deck 228 also remains attached to the boat. As will be recognized from the foregoing description and the figures, the several remaining elements of the framework 14 are detachable one from another and removably mountable in the base mounts. Therefore, when assembling the boat, the upright standards 42, 46, 112 and 118 with their corner mounts secured thereto are initially positioned in their respective base mounts. Thereafter, the transom and bow cross-members 72 and 142 are engaged in their respective corner mounts. As desired, the cross-members 72 and 142 may be permanently secured to their respective standards to facilitate assembly/disassembly. The order of assembling the several elements of the curtain means is optional but in accordance with a preferred order of assembly, the bow and transon curtains are secured to the framework before the side curtains are mounted. Thus, the bow curtain is positioned outside the bow portion of the framework 14 and its top edge overwrapped about the bow cross member 142. Thereupon, the hooks 182 and 184 of the snubber 180 are engaged about the standards 112 and 118 to both secure the top edge of the bow curtain and to urge the standards 112 and 118 toward each other, thereby securing these standards against lateral movement which would dislodge the cross-member 142. Of course, when the cross-members are permanently attached to their respective standards, there is no necessity for the snubber to urge the standards toward one another. The bottom edge of the bow curtain is anchored by engaging the hooks 198 and 200 over the opposite gunnel of the boat. The transom curtain 202 is mounted in substantially like manner as the bow curtain.

For mounting the side curtains, a support member, 148 for example, is inserted into the loop hem of the upper edge of a side curtain so that the opposite ends of the support member project from the opposite side edges of the curtain. As noted hereinbefore, one of the projecting ends of the support member is inserted into a transom corner mount. Thereafter, the opposite end of the support member is brought into approximate alignment with the corresponding bow corner mount, for example, the port corner mount, and the port standard is moved to a nonupright position, that is, in a direction toward the bow of the boat, to permit full alignment of the end of the support member with the port corner mount. Thereupon the port standard is allowed to return to its upright position under the force of its associated spring means in its base mount to engage the end of the support member. The side curtain is then draped outwardly and downwardly over the gunnel of the boat. A C-clamp is applied at approximately the midpoint of the length of the support rib for the side curtain to secure the rib to the gunnel. The opposite side curtain is assembled in like manner. In each of the side curtains depicted in the figures, there are provided lateral wings adjacent the lower edge of the curtain. As desired, these wings can be folded inwardly of the boat and the wings of the two opposite side curtains adjacent the bow of the boat may be secured one to another as by an elastic snubber. In like manner, the wings at the transom ends of the side curtains can be snubbed together, if desired.

For conducting over the gunnel work activities, it becomes necessary only to tilt a bow standard a small amount forwardly of the boat whereupon the side curtain and its support member falls by gravity either into the boat or into the water, or in a preferred situation is festooned over the gunnel, to expose the gunnel for over-the-gunnel work activities. One or both of the side curtains may be lowered at any given time as desired. By reason of the separation of the curtain means into a bow curtain, a transom curtain and opposite side curtain portions, the raising and lowering of a side curtain has no effect upon either the bow curtain or the transom curtain thereby minimizing the effort required by the user to expose the gunnel for over-the-gunnel activities.

It will be recognized that the present blind can be assembled while at dockside or even when the boat remains on a trailer prior to being launched. Thereafter, one or both of the side curtains may be lowered to permit safe boarding of the boat. In this manner, there is removed any danger involved in attempting to erect a blind on a boat after the boat has been launched.

Whereas there has been described a specific embodiment of the present invention, it is intended to limit the invention only in accordance with the appended claims.

What is claimed is:

1. In combination with an open-top boat, a quick-assembly blind comprising a generally rectangular framework releasably secured to said boat and extending to a vertical level above the vertical level of the horizontal plane occupied by the gunnels of said boat and including generally horizontal elongated starboard and port support members, and drapable curtain means depending from said framework to a vertical level approximately equal to the vertical level of said gunnels, said curtain means including port and starboard skirt portions extending below the vertical level of said gunnels between the transom and bow portions of said boat and terminating above the water line of said boat, first and second elongated relatively rigid rib means secured to said curtain means at respective locations immediately adjacent the port and starboard gunnels and extending between the transom and bow portions of said boat, and means releasably securing said first rib means to said port gunnel and means releasably securing said second rib means to said starboard gunnel, said framework including means releasably mounting at least one of said support members whereby when one of said support members is released, said curtain means drops to or below the level of its associated gunnel but remains secured to said gunnel, said framework comprising upright standards mounted adjacent the transom and bow of said boat and releasably receiving therebetween said port and starboard elongated support members which support said curtain means, at least one of said standards being mounted for movement to a non-upright position to remove the support for one of said elongated members and its associated portion of said curtain means to permit such portion of said curtain means to drop to a vertical level generally equal to or below the vertical level of the horizontal plane occupied by the gunnels of said boat thereby permitting over-the-gunnel work activities by a user occupying said boat.

2. The combination of claim 1 and including means biasing said movable standard toward its upright position for supportive engagement with an elongated support member for said curtain means.

3. The combination of claim 1 including hinge means mounting one of said upright standards for movement between upright and non-upright positions, and spring means biasing said standard toward its upright position.

4. In combination with an open-top boat a demountable blind comprising starboard and port base mounts secured to the transom of said boat at respective locations adjacent the starboard and port sides thereof, each of said mounts defining an upwardly opening receptacle, starboard and port upright standards, each having its lower end received in a respective one of said receptacles defined by said transom base mounts, first starboard and port corner mounts received on the upper ends of respective ones of said last mentioned starboard and port standards, said starboard corner mount defining a first receptacle opening in a direction generally parallel to the longitudinal centerline and toward the bow of said boat and a second receptacle opening in a direction generally perpendicular to the longitudinal centerline and toward the port side of said boat, said port corner mounts defining a first receptacle opening in a direction generally parallel to said longitudinal centerline of said boat and toward the bow thereof, and a second receptacle opening in a direction generally perpendicular to said longitudinal centerline and toward the starboard side of said boat, a transom cross-member extending between said last mentioned starboard and port standards, the opposite ends of which respectively are received in said second receptacle defined by said starboard corner mount and in said second receptacle defined by said port corner mount, a first bow cross-member secured at its opposite ends to the starboard and port gunnels, respectively, and extending therebetween at a location adjacent the bow of said boat, starboard and port base mounts secured to said bow cross-member at respective locations adjacent the starboard and port gunnels of said boat, each of said mounts defining an upwardly-opening receptacle, starboard and port upright standards, each having its lower end received in a respective one of said receptacles defined by said last mentioned starboard and port base mounts, further starboard and port corner mounts received on the upper end of respective ones of said starboard and port standards, said starboard corner mount defining a first receptacle opening in a direction generally parallel to the longitudinal centerline and toward the transom of said boat and a second receptacle opening in a direction generally perpendicular to the longitudinal centerline and toward the port side of said boat, said port corner mount defining a first receptacle opening in a direction generally parallel to the longitudinal centerline and toward the transom of said boat and a second receptacle opening in a direction generally perpendicular to the longitudinal centerline and toward the starboard side of said boat, a second bow cross-member extending between said last mentioned starboard and port standards, the opposite ends of which respectively are received in said second receptacle defined by said last mentioned starboard corner mount and in said second receptacle defined by said last-mentioned port corner mount, a first elongated support member extending between said port transom standard and said port bow standard and generally parallel to but spaced at a vertical level above the port gunnel of said boat, the opposite ends of said support member being releasably received within respective ones of said first receptacle defined in said port corner mount received on said port transom standard and said first receptacle defined by said port corner mount received on said port bow standard, a second elongated support member extending between said starboard transom standard and said starboard bow standard and generally parallel to but spaced at a vertical level above the starboard gunnel of said boat, the opposite ends of said second support member being releasably received within respective ones of said first receptacle defined by said starboard corner mount received on said starboard transom standard and said first receptacle defined by said starboard corner mount received on said starboard bow standard, bow curtain means depending from said second bow cross-member to at least the vertical level of the horizontal plane occupied by said boat gunnels and extending between said starboard and port bow standards, means releasably anchoring the opposite side of said bow curtain means to respective ones of the starboard and port gunnels of said boat, port side curtain means depending from said first elongated side member to a vertical level adjacent the port gunnel and above the water line of said boat and extending between said port transom standard and said port bow standard, first relatively rigid rib means secured to said port side curtain means at a vertical level adjacent the port gunnel and extending substantially parallel to said port gunnel between said port transom standard and said port bow standard, means releasably securing said rib means to said port gunnel, second relatively rigid rib means secured to said starboard curtain means at a vertical level adjacent the starboard gunnel and extending substantially parallel to said starboard gunnel between said starboard transom standard and said starboard bow standard, means releasably securing said starboard rib means to said starboard gunnel, transom curtain means depending from said transom cross-member to a vertical level below the top edge of said transom but above the water line of said boat and extending between said starboard and port transom standards, and means releasably securing the opposite side edges of said transom curtain means to respective opposite sides of said boat.

5. The combination of claim 4 including resilient means secured to each of said bow and transom curtain means adjacent the upper edge thereof at respective locations between said bow standards and said transom standards and having opposite ends thereof engaging respective bow standards and transom standards to urge said bow standards toward one another and to urge said transom standards toward one another.

* * * * *

UNITED STATES PATENT OFFICE

CERTIFICATE OF CORRECTION

Patent No. 4,300,253 Dated November 17, 1981

Inventor(s) William L. Anderson

It is certified that error appears in the above-identified patent and that said Letters Patent are hereby corrected as shown below:

Column 4, line 67, change "alignments" to -- alignment --.

Column 4, line 67, change "second" to -- first --.

Column 5, line 33, change "78" to -- 228 --.

Column 5, line 68, change "186" to -- 86 --.

Column 6, line 45, change "winds" to -- wind --

Column 7, line 44, change "transon" to -- transom --.

Signed and Sealed this

*Sixteenth* Day of *February 1982*

[SEAL]

*Attest:*

GERALD J. MOSSINGHOFF

*Attesting Officer* *Commissioner of Patents and Trademarks*